United States Patent [19]

Lackey et al.

[11] 4,262,493

[45] Apr. 21, 1981

[54] HEAT PUMP

[75] Inventors: Robert S. Lackey, Pittsburgh; Robert R. Young, Murrysville, both of Pa.

[73] Assignee: Westinghouse Electric Corp., Pittsburgh, Pa.

[21] Appl. No.: 63,240

[22] Filed: Aug. 2, 1979

[51] Int. Cl.[3] ..... F25B 13/00

[52] U.S. Cl. ..... 62/324.6

[58] Field of Search ..... 62/324 A, 324 R, 160

[56] References Cited

U.S. PATENT DOCUMENTS

| | | | |
|---|---|---|---|
| 3,005,320 | 10/1961 | Bodell | 62/324 R |
| 3,024,619 | 3/1962 | Gerten et al. | 62/324 A |
| 3,308,877 | 3/1967 | Gertis | 62/238 E |
| 3,534,806 | 10/1970 | Rodgers | 165/1 |
| 4,045,974 | 9/1977 | McCarty | 62/324 |
| 4,057,975 | 11/1977 | del Toro et al. | 62/324 |
| 4,057,976 | 11/1977 | del Toro et al. | 62/324 |
| 4,057,977 | 11/1977 | Chambless | 62/324 |
| 4,171,622 | 10/1979 | Yamaguchi et al. | 62/324 R |
| 4,180,988 | 1/1980 | Forte | 62/324 A |
| 4,182,133 | 1/1980 | Haas et al. | 62/324 R |

*Primary Examiner*—Lloyd L. King
*Attorney, Agent, or Firm*—E. C. Arenz

[57] ABSTRACT

A heat pump is provided with an outdoor heat exchanger 30 having a main section 30*a* and a subcooling section 30*b*, with a circuiting arrangement and distribution and control means including expansion device 48, check valve 54 and lines 52, 56, 58 and 60 connected so that in a cooling mode of operation of the unit the refrigerant flows through the main section and then the subcooling section in series, and in a heating mode of operation the refrigerant flows only through the main section with the subcooling section receiving refrigerant for storage.

7 Claims, 4 Drawing Figures

HEAT PUMP

BACKGROUND OF THE INVENTION

This invention pertains to the art of heat pumps generally, and in particular to the art of refrigerant flow circuiting and circuiting changes occurring when the heat pump is shifted between heating and cooling modes of operation.

While the invention is considered broadly applicable to heat pumps of various sizes and types, it will be described herein as embodied in roof-top packaged heat pumps of nominal 7½ and 10 ton sizes. The general structural arrangement of a roof-top packaged unit which, as disclosed, was arranged for a cooling operation only but adaptable to be modified for operation as a heat pump is shown in U.S. Pat. No. 4,139,052. In modifying that particular type unit for heat pump operation, while simultaneously attempting to achieve high capacity per unit volume, high energy efficiency ratio in cooling, and high coefficient of performance in heating, several changes were required in connection with the indoor and outdoor heat exchangers or coils. The surface areas of both the indoor and outdoor coils are increased relative to the cooling-only unit to offset the deleterious effect of the added refrigerant pressure drop resulting from the addition of the required refrigerant reversing valve necessary for heat pump operation. The added pressure drop for refrigerant flowing through the suction side of the valve in effect reduces the available temperature difference between the airstream and the refrigerant, thus making it necessary to increase the effective surface areas of the coils. Of course, the increase in size of the outdoor coil results, in the cooling mode of operation, in a more effective condensing section. The net result of the increase in coil sizes is that in the cooling mode of the heat pump the system operates at approximately the same capacity over about the same net temperature difference as does such a unit designed for cooling only and which hence has less refrigerant pressure drop.

The genesis of this invention stems from these changes in the coils. The end result of the invention is to increase the effectiveness of the outdoor coil in a heat pump by providing adequate subcooling to the refrigerant when the heat pump is operating in a cooling mode, while also allowing that same coil to operate relatively efficiently as an evaporator in the heating mode.

SUMMARY OF THE INVENTION

In accordance with the invention the heat pump is provided with an outdoor heat exchanger having a plurality of refrigerant flow circuits covering the major extent of the airflow surface of the exchanger, and separate refrigerant flow circuit means covering the remaining extent of the airflow surface of the exchanger; and refrigerant expansion and check valve means are provided for the outdoor heat exchanger along with means connecting the heat exchanger, expansion means and check valve means in an arrangement in which with the refrigerant flow in one direction with the heat exchanger acting as a condenser, the flow passes first through the plurality of circuits and then through the separate circuit means in series flow, and with the refrigerant flow in the other direction and the heat exchanger functioning as an evaporator the flow passes only through the plurality of circuits and is prevented from flowing through and out of the separate circuit.

With this arrangement the separate circuit means can function effectively as a subcooler when the unit is in a cooling mode, and with this separate subcooler circuitry removed from the active refrigerant path when the unit is operated in a heating mode. Additionally, in the heating mode the subcooler circuitry is available for storage of refrigerant.

Additionally, the feed to the plurality of circuits is at locations remote from the location of the separate refrigerant flow circuit means so that any portion of the plurality of circuits which is located physically adjacent the separate circuit means is the down stream portion of any such plurality of circuits, this arrangement reducing thermal coupling of the separate circuit means to the plurality of circuits.

Finally, the separate refrigerant flow circuit means is circuited in a counterflow arrangement with respect to airflow through the coil to promote the function of the separate circuit means as a subcooling section when the unit is operating in a cooling mode.

DRAWING DESCRIPTION

DESCRIPTION OF AN EMBODIMENT

Figure 1:
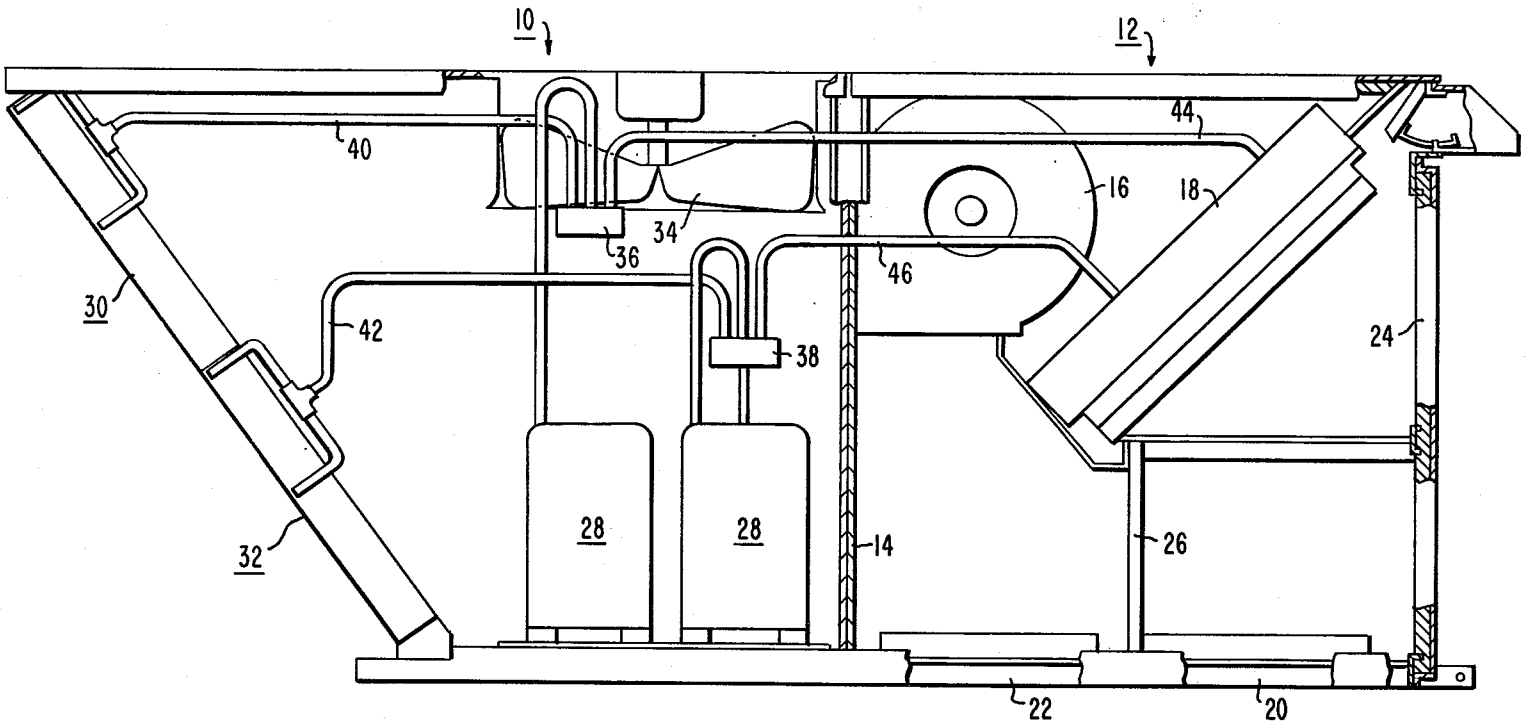
FIG. 1 is a side view of a roof top unit of the heat pump type embodying the invention, the side panels of the unit being omitted to permit a view of the interior arrangement.

Referring to FIG. 1, the unit is basically divided into an outdoor airflow section 10 and an indoor airflow section 12, both within the outer cabinet which is separate interiorly into the two sections by an intermediate vertical partition 14. Airflow through the indoor section is induced by the centrifugal fans 16 into the section, through the indoor heat exchanger 18 and is forced out of the indoor section back to the served space. In the configuration shown in FIG. 1 the air inlet is designated 20 while the air outlet is designated 22. The note U.S. Pat. No. 4,139,052 discloses how the separable end panel 24 and detachable interior panel 26 may be arranged in various ways to accomplish recircuiting of the airflow path into and out of the indoor section.

In the embodiment shown in FIG. 1, two separate refrigerant circuits are provided, each with its own compressor 28 located in the outdoor airflow section. The outdoor airflow section 10 also includes the inclined outdoor coil comprising an upper section 30 and a lower section 32, the outdoor airflow fan 34 and various refrigerant line and associated elements, only part of which are shown in FIG. 1 in a schematic form. These parts include a refrigerant flow reversing valve 36 for one of the separate refrigerant circuits and 38 for the other circuit. Lines 40 and 42 extending from the reversing valves to the two separate sections of the outdoor coil function as suction lines when the unit is in a heating mode and as the hot gas lines when the unit is in the cooling mode. The lines 44 and 46 extending from the reversing valves to the indoor coil 18 (which also comprises two separate sections), correspondingly function as suction gas lines in the cooling mode and as the hot gas discharge lines in the heating mode. The other two lines extending from the reversing valves as shown in FIG. 1 are the compressor discharge and suction lines, it being noted that the suction lines pass to accumulators which are not shown.

Figure 2:
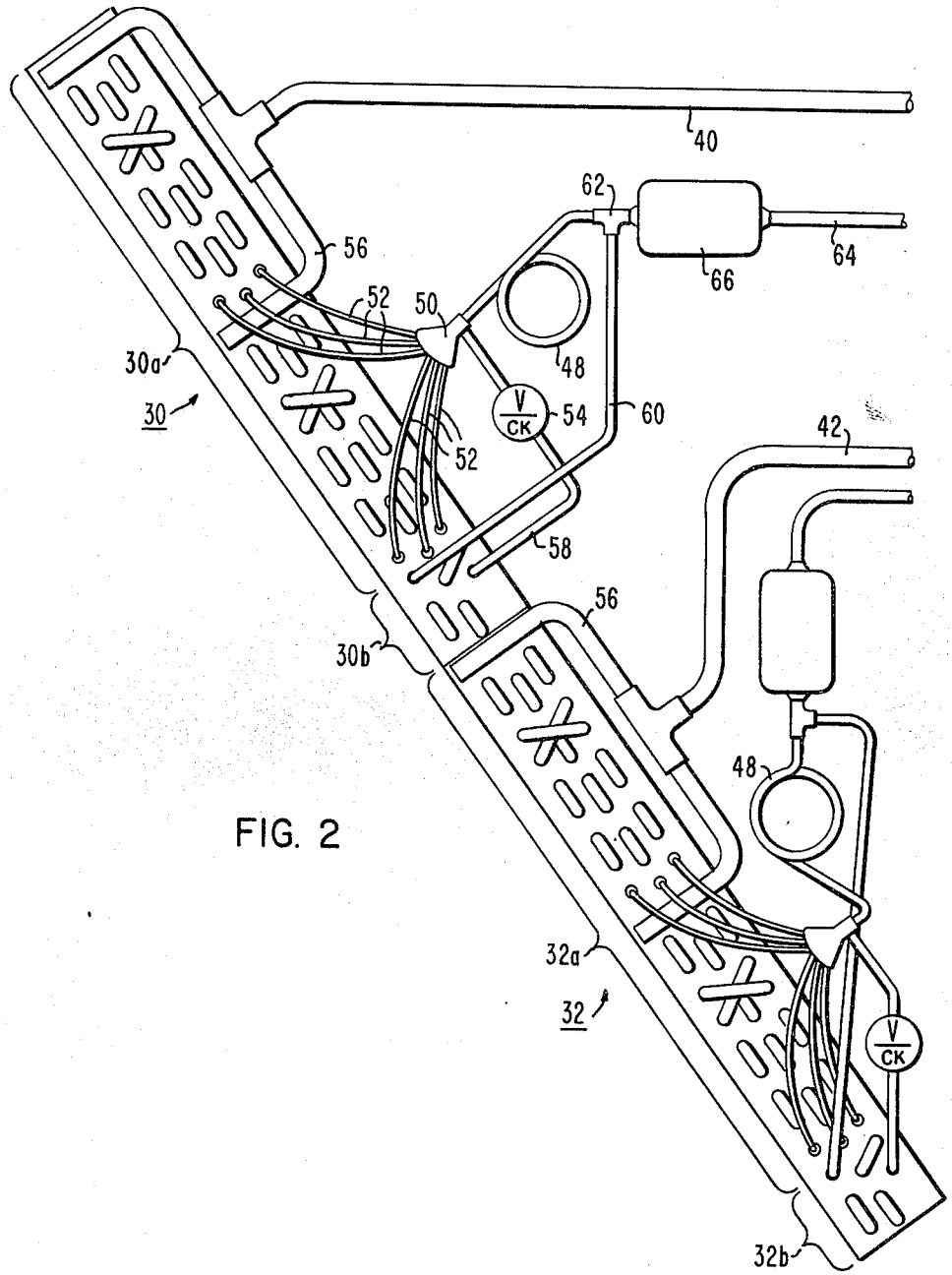
FIG. 2 is a fragmentary side view of that part of the unit provided with the outdoor coil or heat exchanger, along with associated control and distribution means.

Referring now to FIG. 2, the distribution and control means associated with each of the two sections 30 and 32 of the outdoor coil are identically designated for each of the two sections. They include capillary tube 48 connected at one end to a side port distributor 50 provided with six individual distributing tubes 52, the side port of the distributor being connected to one side of the check valve 54 which permits flow in a direction from the side port distributor through the check valve but not in the opposite direction.

The separate outdoor coil sections 30 and 32 shown are each three tubes deep in the direction of airflow. The sections are of conventional tube and fin construction in which the tubes extend horizontally between the opposite ends of the coil and through apertures in the vertically disposed fins. Each section is circuited to provide a plurality of refrigerant flow circuits covering the major extent of the airflow surface of the exchanger and indicated by the bracketed portions 30*a* and 32*a*, and separate refrigerant flow circuit means covering the remaining extent of the airflow surface of the exchanger and indicated by the bracketed portions 30*b* and 32*b*. These separate circuit means will hereafter be referred to as the subcooler sections of the coil since they so function in the cooling mode of operation of the unit.

The fins of the upper and lower sections 30 and 32 are separate (not continuous between the sections) and a thermal break is thus provided between the coils. This break also permits condensate to drip off the coil at the break line, as well as at the bottom, during defrost.

In the particular heat exchanger illustrated, each of the major parts of a coil section such as 30*a* and 32*a* are circuited to provide six separate refrigerant flow circuits. One end of each of these circuits is connected to the manifold 56, which in turn is connected to line 40 (and in the lower section 32*a*, line 42), while the opposite end of each of the circuits is connected to one of the distribution tubes 52.

Regarding the subcooler section circuits, one end of the circuit is connected by line 58 to the outlet port of the check valve 54, while the opposite end of the circuit is connected by line 60 to a junction 62 which is also connected to one end of the capillary tube and to line 64 through a filter dryer 66. As is conventional practice in such heat pumps, the lines 64 extend to the two sections of the indoor coil 18 through an expansion device and parallel check valve (neither of which is shown).

Figure 3:
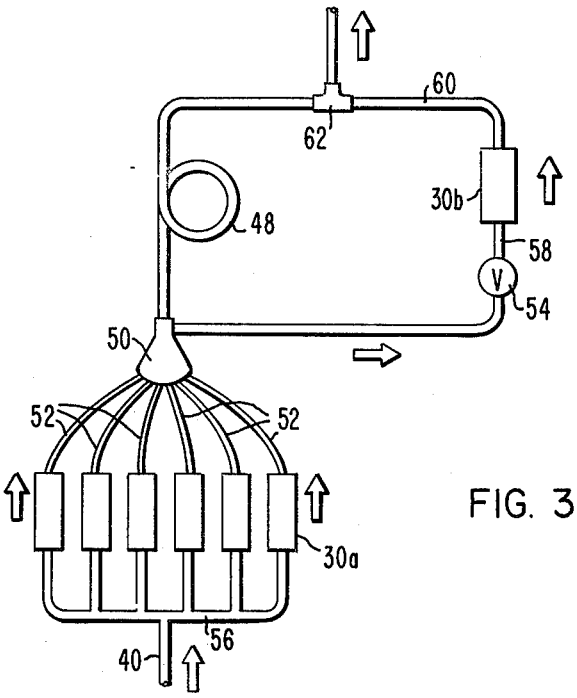
FIG. 3 is a schematic view of the outdoor coil and associated control and distribution means, and illustrating the flow of refrigeration through these parts when the heat pump is operating in a cooling mode.
Figure 4:
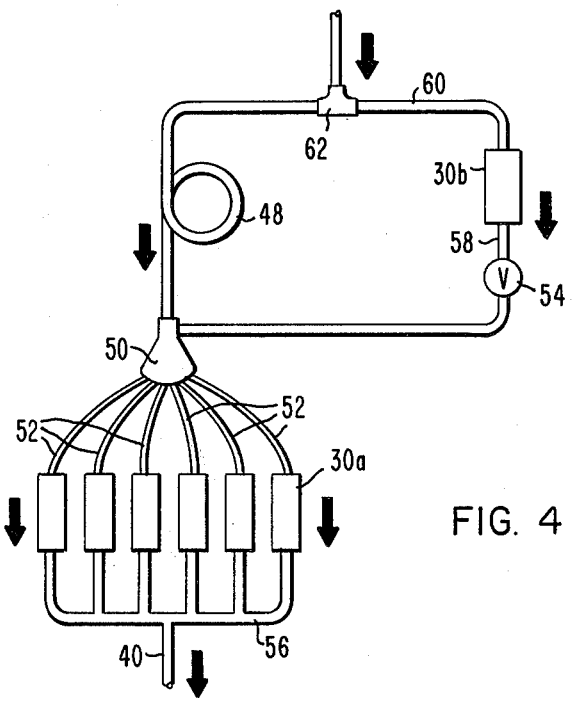
FIG. 4 is a view similar to FIG. 3 in which the arrows illustrate the flow of refrigerant when the heat pump is operating in a heating mode.

To assist in understanding the arrangement of the refrigerant flow circuits in the exchangers and their relation to the control and distributions means, FIGS. 3 and 4 are provided to show the flow paths schematically. Only the upper section 30 is indicated as being involved in these figures, it being understood that the lower section 32 has precisely the same flow paths.

In FIG. 3 the heat pump is assumed to be operating in a cooling mode in which the outdoor heat exchanger functions as a condenser. The path of refrigerant flow is indicated by the open arrows. Hot gas from the reversing valve flows through line 40 to the manifold 56 where it is split into the six separate flow paths which constitute the main extent 30*a* of the heat exchanger, and after flowing through the tubes back and forth between the ends of the coils exit through the distribution tubes 52 to the side port distributor 50. From the side port distributor the flow is through the check valve 54 and line 58 to the subcooler section 30*b*, from which the subcooled liquid refrigerant exits through line 60 to the junction 62 and from thence to the indoor coil functioning as an evaporator.

In FIG. 4 the same arrangement is shown but with the heavy arrows indicating the refrigerant flow path occurring when the unit is operating in a heating mode and the outdoor heat exchanger is functioning as an evaporator. In this case liquid refrigerant from the indoor coil (functioning as a condenser) flows to the junction 62 and through the capillary tube 48 where it undergoes expansion to the side port distributor 50. Concurrently some refrigerant will flow initially through line 60 into the subcooler section 30*b* but is prevented from passing beyond the check valve 54. The liquid refrigerant flowing into the subcooler section is stored as such in the subcooler section in the heating mode of operation. The expanded refrigerant is passed from the side port distributor 50 through the distribution tubes 52 to the six separate circuits of the major portion 30*a* of the heat exchanger, and thence through the manifold 56 to the line 40 serving as a suction line connected to the compressor through the reversing valve.

It will thus be apparent that with the arrangement of circuiting in the outdoor heat exchanger, along with the refrigerant expansion means, check valve means and means connecting these elements, that an arrangement if provided in which with the refrigerant flow in one direction corresponding to the heat pump operating in a cooling mode, the refrigerant flow passes first through the plurality of circuits of the heat exchanger and then through the separate subcooler circuit in series flow; and with the refrigerant flow in the other direction when the heat pump operates in a heating mode the flow passes only through the plurality of circuits of the heat exchanger and is prevented from flowing through and out of the separate subcooler circuit.

It will also be apparent from the schematic representations that the separate subcooler circuit 30*b* and the check valve 54 are connected in a series circuit, and that series circuit in turn is in parallel with the capillary tube 48. The use of the separate subcooler section 30*b* as a storage volume is accomplished by providing the check valve 54 on the downstream end of the subcooler circuit 30*b* under conditions when the refrigerant flow is as indicated in FIG. 4.

It may also be seen from the circuiting arrangement of the heat exchanger in FIG. 2 that, when the outdoor heat exchanger is functioning as a condenser and the hot gas is being delivered through the manifold 56, the delivery to the plurality of circuits by this manifold is at a location remote from the physical location ofthe subcooler section. Thus even those portions of the plurality of circuits which are located physically adjacent the subcooler section constitute the downstream portions of these circuits in the cooling mode and accordingly thermal coupling through the fins between the subcooler section and the main part of the coil is reduced.

It may also be seen from FIG. 3 that the circuitry of the subcooler section is such that, when it is functioning as a subcooler and receiving refrigerant liquid through line 58, the circuitry is that of a counterflow arrangement with respect to airflow through the heat exchanger. This promotes the subcooling function of the section.

Thus the total arrangement allows for adequate subcooling of the refrigerant when the unit is operated in a cooling mode, but does not burden the outdoor coil with the pressure drop which would be associated with passing all of the system refrigerant through a series circuit of eight tubes (which the subcooling section comprises) when the outdoor coil must function as an evaporator in the heating mode. The eight unused tubes of the subcooling section serve as a storage volume for system refrigerant when the unit operates in the heating mode and the system requires less active charge. Thus most of the indoor coil is therefor available as an active condenser since it need not perform any storage function.

We claims:

1. A heat pump operable to heat and to cool, comprising:

a refrigerant compressor;

and indoor heat exchanger;

an outdoor heat exchanger having a plurality of refrigerant flow circuits covering the major extent of the air flow surface of the exchanger, and separate refrigerant flow circuit means covering the remaining extent of the airflow surface of the exchanger;

reversing valve means for changing the refrigerant flow from one direction in which said outdoor exchanger acts as a condenser to the direction in which said outdoor exchanger acts as an evaporator;

refrigerant expansion means and check valve means for said outdoor heat exchanger;

means connecting said outdoor heat exchanger, expansion means and check valve means in an arrangement in which with said flow in said one direction, said flow passes first through said plurality of circuits and then said separate circuit means in series flow, and with said flow in said direction, said flow passes only through said plurality of circuits and is prevented from flowing through and out of said separate circuit.

2. A heat pump according to claim 1 wherein:

said separate refrigerant flow circuit means and said check valve means are connected to form a series circuit, and said series circuit is in parallel with said refrigerant expansion means.

3. A heat pump according to claim 2 wherein:

said check valve means is downstream from said separate refrigerant flow circuit means when said flow is in said other direction.

4. A heat pump according to claim 1 wherein:

said separate refrigerant flow circuit means is located adjacent an edge of said heat exchanger; and said connecting means include line means connected to feed said plurality of circuits, with said flow in said one direction and said heat exchanger functioning as a condenser, at locations remote from the location of said separate refrigerant flow circuit means so that any portion of said plurality of circuits located physically adjacent said separate circuit means constitutes the downstream portion of said plurality of circuits, and thereby reduces thermal coupling of said separate circuit means to said plurality of circuits.

5. A heat pump according to claim 1 wherein:

said heat exchanger is of multi-row depth; and said connecting line means is connected and said separate refrigerant flow circuit means is circuited in a counterflow arrangement to promote the function of said separate circuit means as a subcooling section when said refrigerant flow is in said one direction.

6. A heat pump according to claim 1 wherein said pump includes a pair of separate refrigerant systems the two outdoor heat exchanger sections being separate and arranged in and inclined planar disposition with the lower edge of the upper section being adjacent the upper edge of the lower section, and with the fins of the separate sections being disassociated at the location of adjacency to provide a thermal break therealong.

7. In a heat pump having an outdoor heat exchanger operable as an evaporator and alternatively as a condenser, depending upon the direction of refrigerant flow:

a plurality of refrigerant flow circuits covering the major extent of the airflow surface of the exchanger;

separate refrigerant flow circuit means covering the remaining extent of the airflow surface of said exchanger;

refrigerant flow control and distribution means for routing refrigerant flow first through said plurality of refrigerant flow circuits and then through said separate refrigerant flow circuit means when the refrigerant flow is in one direction and in which said exchanger acts as a condenser, and for routing refrigerant flow through refrigerant expansion means into, through and out of said plurality of refrigerant circuits and also directly into said separate refrigerant flow circuit means when the refrigerant flow is in the other direction in which said exchanger acts as an evaporator, said flow control and distribution means including means preventing the flow of refrigerant from said separate refrigerant flow circuit means when the flow is in said other direction and permitting flow from said plurality of refrigerant flow circuits to said separate refrigerant flow circuit means when the flow is in said one direction.

* * * * *